United States Patent [19]

Roach

[11] Patent Number: 5,054,685

[45] Date of Patent: Oct. 8, 1991

[54] CLAD MAILBOX

[76] Inventor: Dan V. Roach, Star Route E, Monterey, Va. 24465

[21] Appl. No.: 517,212

[22] Filed: May 1, 1990

[51] Int. Cl.[5] ..... B65D 91/00

[52] U.S. Cl. ..... 232/17; 232/38

[58] Field of Search ..... 232/17, 38, 24; 52/86

[56] References Cited

U.S. PATENT DOCUMENTS 118,696 1/1940 Driver .

287,899 1/1987 Lindheimer .

4,375,869 3/1983 Hatch .

*Primary Examiner*—Blair M. Johnson

*Attorney, Agent, or Firm*—King & Schickli

[57] ABSTRACT

A clad mailbox includes a main housing and at least one side panel, a bottom panel and an end panel. The side panel forms an arcuate roof over the bottom panel and, together, the side panel, bottom panel, and end panel form the mailbox enclosure. A lid may be pivotably mounted to the side panel or bottom panel for opening and closing the mailbox. A track is mounted on the outer face of one of the panels of the housing. Cladding is received on and positively retained to that panel. More particularly, the cladding includes a guide groove cooperatively shaped to be received over and engaged by the track so as to hold the cladding in proper alignment and position on the panel.

8 Claims, 1 Drawing Sheet

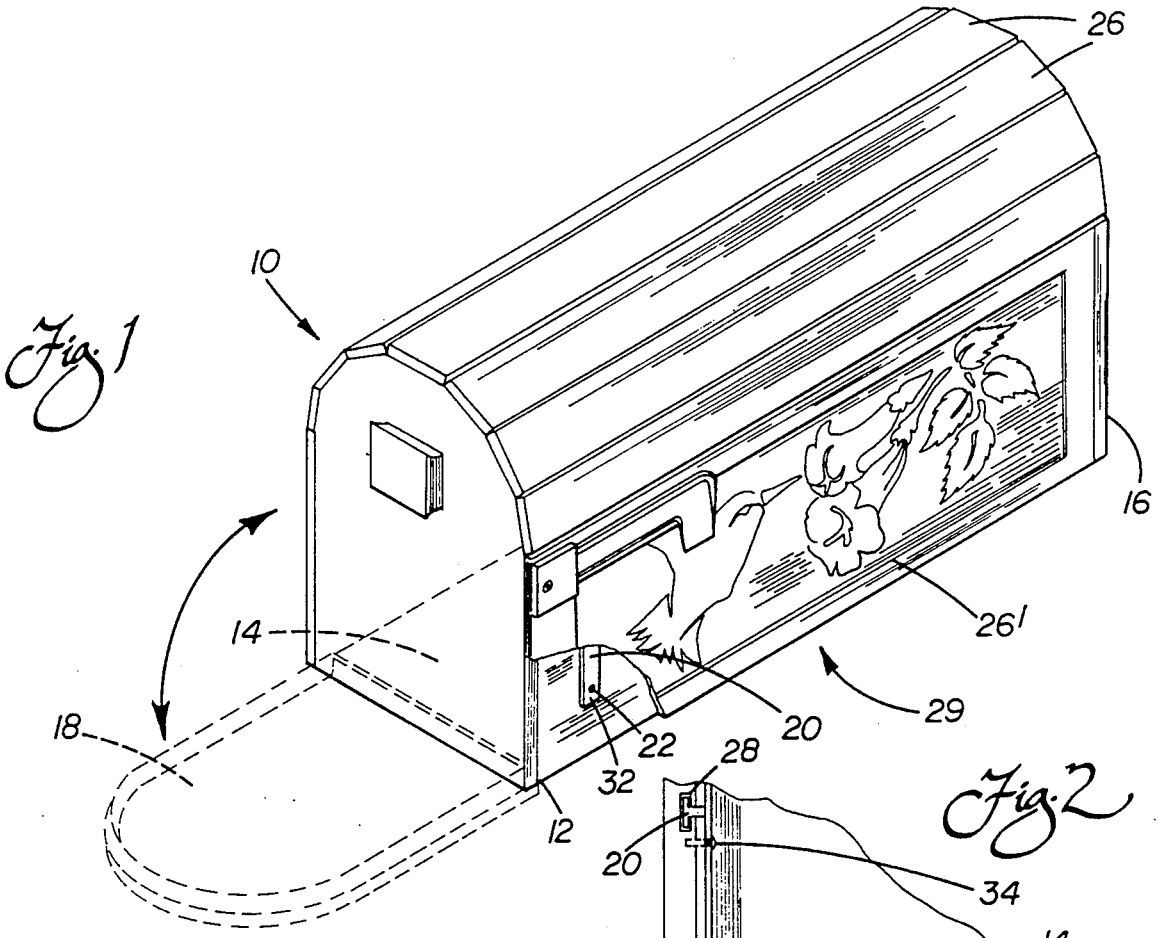
Fig. 1
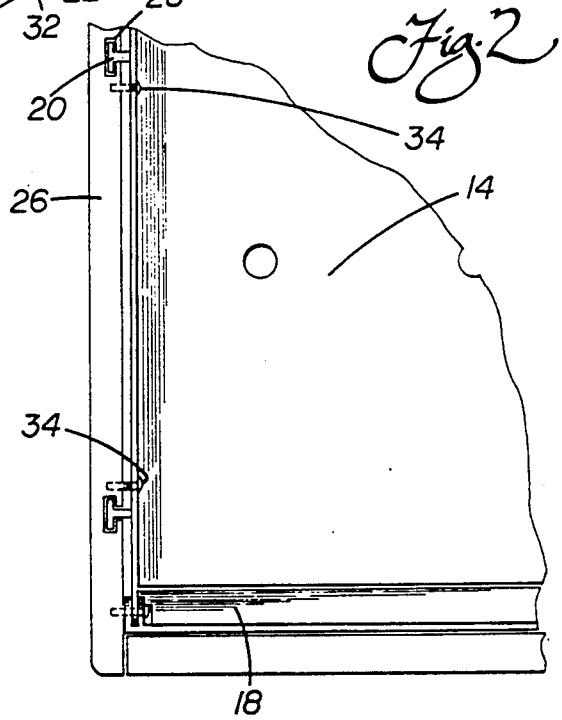
Fig. 2
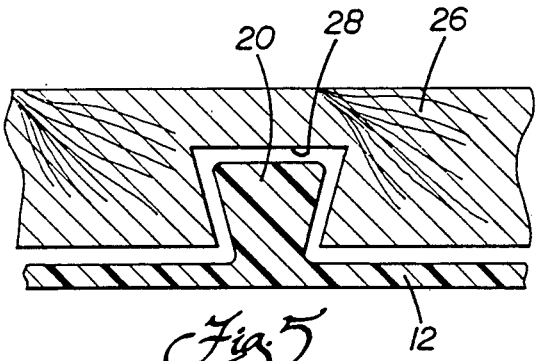
Fig. 5
Fig. 4
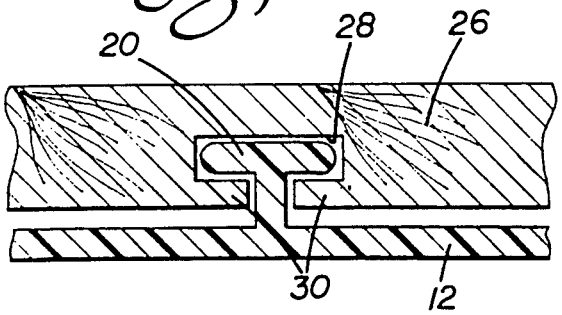
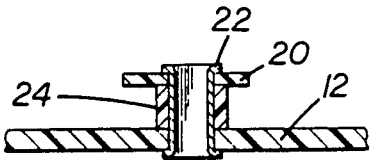
Fig. 3

CLAD MAILBOX

TECHNICAL FIELD

The present invention relates generally to mailboxes and protective enclosures or covers, and, more particularly, clad mailboxes wherein the cladding may be conveniently changed to present a variety of decorative designs.

BACKGROUND OF THE INVENTION

Conventional mailboxes are well-known throughout America. Mailboxes are made of sheet metal panels or molded plastic typically having a arcuate roof and a hinged door or a lid to gain access to the mailbox enclosure.

While particularly functional, plain mailboxes have a relatively drab, unattractive appearance. This shortcoming has, however, been addressed in the art by the development of a number of mailbox covers such as shown in the U.S. Design Pat. No. 287,899 to Lindheimer and U.S. Design Pat. No. 118,696 to Driver as well as U.S. Utility Pat. No. 4,375,869 to Hatch. Each of these patents disclose mailbox covers including wooden slats which are received over and cover the mailbox. Not only are these covers aesthetically pleasing, they also advantageously provide a degree of protection to the mailbox. This is an important aspect of the covers since mailboxes are commonly targeted by vandals who throw objects at them from moving vehicles.

The vandalism problem is of particular concern when it is considered that covers known in the art are designed as an integrated assembly. For example, the protective cover disclosed in the Hatch patent includes a series of slats arranged in parallel and in a row with one slat laterally of and adjacent to the next slat in the row. Each of the slats is joined to flexible members, such as strips of synthetic rubber or nylon, which hold all the slats together for draping over a mailbox.

Unfortunately, when one of these slats of the assembly becomes marred and/or broken through, for example, impact with a rock or other object thrown from a vehicle, replacement of the slat requires removal of the entire assembly from the mailbox. After removal of the damaged slat, a new slat must be aligned and carefully positioned on the flexible members that hold the cover assembly together. The slat must also be attached to the flexible members in some way in order to complete the repairs. Unfortunately, this is an inconvenient and tedious process. Further, in some cases, the damage may even require the purchase of a new cover assembly. Unfortunately, this is also an inconvenient and expensive procedure which, further, could be avoided.

SUMMARY OF THE INVENTION

Accordingly, it is a primary object of the present invention to provide a mailbox with a readily replaceable cover overcoming the above-described limitations and disadvantages of the prior art.

Another object of the present invention is to provide a clad mailbox of simple, inexpensive construction.

Yet another object of the present invention is to provide a clad mailbox specifically adapted to receive cladding panels or slats of varying widths incorporating distinctive decorative designs.

Yet another object of the present invention is to provide a clad mailbox wherein the cladding panels may be conveniently replaced so as to change the decorative design on the mailbox and/or conveniently repair damaged cladding panels in a short period of time utilizing only simple hand tools.

Additional objects, advantages, and other novel features of the invention will be set forth in part in the description that follows and in part will become apparent to those skilled in the art upon examination of the following or may be learned with the practice of the invention. The objects and advantages may be realized and attained by the means of the instrumentalities and combinations particularly pointed out in the appended claims.

To achieve the foregoing and other objects, and in accordance with the purposes of the present invention as described herein, an improved clad or covered mailbox is provided. The clad mailbox includes a main housing having at least one side panel, a bottom panel, and an end panel. The side panel may be folded over so as to form an arcuate roof section. Together, the side panel, bottom panel and end panel form a covered enclosure for receiving and holding mail or other articles.

The mailbox also includes a track mounted to an outer face of one of the panels of the housing. Preferably, the track extends outwardly from the outer face of the side panel forming the sides and roof of the mailbox. Cladding, such as wood panels of varying width, are received on and positively retained to the mailbox. More specifically, the cladding includes guides, in the form of grooves, that are cooperatively shaped to be received over and engaged by the track on the mailbox panel. Together, the cooperating track and groove serve to hold the cladding in proper alignment and position on the panel so as to present an aesthetically pleasing appearance.

More specifically, the track mounted to the main housing may take the form of a flexible strip of plastic material that is attached to the panel by means of rivets. Plastic sleeves received about the rivets serve to space the strip from the face of the panel. In preferred embodiments, the track may be either substantially T-shaped or V-shaped. Similarly, the cooperating guide means is a substantially T-shaped groove running through the cladding and a substantially V-shaped groove running through the cladding, respectively. Fasteners, such as screws, are provided for anchoring the cladding and, more specifically, the end panels of the cladding to the main housing. This serves to prevent the cladding from slipping off the end of the track and therefore maintains the cladding in proper position.

It should be appreciated, however, that the cladding may be simply and easily removed and replaced by removing these screws and slipping the cladding panels from the track. New panels may then be slipped over the end of the track into proper position. Then the screws are again extended through an aperture in the main housing into the end panels of the cladding to retain the cladding in proper position.

Still other objects of the present invention will become readily apparent to those skilled in the art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and description should be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In, the drawing:

FIG. 1 is a partially cut away perspective view of the clad mailbox of the present invention;

FIG. 2 is a detailed fragmentary view showing a cladding panel received on the track mounted to the main housing of the mailbox of the present invention;

FIG. 3 is a detailed sectional view showing the attachment of the track to the main housing of the mailbox utilizing a rivet;

FIG. 4 is a partially sectional view of an alternative embodiment showing the attachment of a cladding panel to a substantially T-shaped track molded or welded to the main housing of the mailbox;

FIG. 5 is a detailed, partially sectional view of another alternative embodiment showing the attachment of a cladding panel to a substantially V-shaped track molded or welded to the housing of the mailbox of the present invention.

Reference will now be made in detail to the present preferred embodiment of the invention, an example of which is illustrated in the accompanying drawing.

DETAILED DESCRIPTION OF THE INVENTION

Reference is now made to FIG. 1, showing the improved clad mailbox 10 of the present invention. As shown, the mailbox 10 includes a main housing including at least one side panel 12, a bottom panel 14, and an end panel 16. The side panel 12 forms an arcuate roof over the bottom panel 14. Together, the side panel 12, bottom panel 14 and end panel 16 form the mailbox enclosure. A lid 18 pivotally mounted to the side panel 12 or bottom panel 14 may be moved from a closed position shown in full line to an open position shown in phantom line to allow access to the interior of the mailbox 10. As should be appreciated, the main housing may be formed from metal, such as aluminum, or plastic as is known in the art.

As best shown in FIGS. 1 and 2, a pair of tracks 20 are mounted to an outer face of the side panel 12 of the housing. As shown in detail in FIGS. 2 and 3, the tracks 20 may be formed from a strip of flexible material such as nylon or plastic that is mounted to the side panel 12 by means of a series of rivets 22. A spacer sleeve 24 is received concentrically about each of the rivets 22. Each spacer sleeve 24 serves to maintain the track strip 20 a selected distance above the face of the side panel 12.

Cladding, in the form of a series of slats or panels 26, is received over and positively retained to the side panel 12. More particularly, each cladding panel 26 includes a pair of guide grooves 28 extending transversely across the full width of the panels. The guide grooves 28 are cooperatively shaped to be received over and engaged by the tracks 20 to thereby hold the cladding panel 26 in proper alignment and position on the side panel 12. Accordingly, as shown in FIG. 2, the guide grooves 28 are substantially T-shaped to be received over and engage the track strip 20.

In the alternative embodiment shown in FIG. 4, the T-shaped track 20 is integrally molded with or welded to the side panel 12. Once again, the cooperating groove 28 in the cladding panel 26 is similarly T-shaped to form a channel 29 that receives the distal, enlarged end of the track 20 while providing shoulders 30 that abut the enlarged end to retain the cladding panel 26 against the side panel 12.

In the alternative embodiment shown in FIG. 5, the track 20 is substantially V-shaped with side walls diverging outwardly from the surface of the side panel 12. Similarly, the guide groove 28 in the cladding panel 26 is substantially V-shaped so as to be cooperatively received over the track 20. Together, the track 20 and the guide groove 28 of the embodiment shown in FIG. 5 effectively form a dovetail joint that positively retains the cladding panel 26 in proper alignment against the side panel 12 of the main housing of the mailbox 10.

No matter which embodiment is selected, the cladding panels 26 may be easily applied and retained to the main housing. More particularly, a cladding panel 26 is held so that the guide grooves 28 are aligned with the terminal ends 32 of the tracks 20. The cladding panel 26 is then manipulated so as to cause the tracks 20 to be received in the grooves 28. The cladding panel 26 is then slid onto the main housing and the next cladding panel is aligned and positioned in the same manner. Once all the cladding panels 26 are positioned on the tracks 20 so as to cover the main housing of the mailbox 10, a pair of mounting screws 34 are tightened in aligned apertures provided in the end cladding panels (note 26' in FIG. 1) and the mailbox side panel 12. Similarly, decorative cladding panels 36 may be attached to the lid 18 and end panel 16 of the mailbox by means of screws or other means to provide a more complete and appealing aesthetic appearance. Of course, it should be recognized that the cladding panels 26 may include distinctive decorative designs, generally designated by reference numeral 29 in FIG. 1, to increase their appeal.

In the event it is ever desired to change the decorative design or repair or replace a cladding panel 26, it should be appreciated that this may easily be accomplished simply by using a screwdriver. More particularly, the mounting screws 34 in one of the end panels 26' are removed. The cladding panel 26 to be replaced or repaired and any intervening cladding panels are then removed from the track 20 by sliding along the track over the distal end of the track 32. The replacement cladding panel 26 is then positioned on the track as described above along with any other cladding panels necessary to complete the covering of the main housing of the mailbox 10. The mounting screws 34 are then reaffixed in the end cladding panel 26' to secure the cladding panels in proper position.

In summary, numerous benefits have been described which result from employing the concepts of the present invention. Advantageously, the construction of the improved clad mailbox of the present invention is relatively simple and inexpensive. Despite this, the unique design allows easy removal and replacement of cladding panels with the utilization of a screwdriver alone. Accordingly, the mailbox owner may repair a damaged panel or change decorative panels as desired. For example, the owner could desire to utilize a decorative panel incorporating a Santa Claus during the Christmas season. Such panels are relatively inexpensive and may be made freely available to mailbox owners in kit form.

The foregoing description of the preferred embodiment of the present invention has been presented for the purposes of illustration and description. It is not intended to be exhaustive or to limit the invention to the precise form disclosed. Obvious modifications or variations are possible in light of the teachings. The embodiment was chosen and described to provide the best illustration of the principles of the invention and its practical application thereby enabling one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

I claim:

1. A clad mailbox, comprising:

a main housing including at least one side panel, a bottom panel and an end panel;

track means mounted on an outer face of one of said panels of said housing;

cladding means received on and positively retained to said one panel, said cladding means including guide means cooperatively shaped to be received over and engaged by said track means to hold said cladding means in proper alignment and position on said one panel.

2. The clad mailbox of claim 1, further including fastening means for attaching said cladding means to said main housing and preventing said cladding means from slipping off an end of said track means.

3. The clad mailbox of claim 1, wherein said track means includes a flexible strip attached to said one panel by means of rivets, said strip being spaced from said one panel by means of sleeves received about said rivets.

4. The clad mailbox of claim 1, wherein said track means is substantially T-shaped and said guide means is a substantially T-shaped groove running through said cladding means.

5. The clad mailbox of claim 1, wherein said track means is substantially V-shaped and said guide means is a substantially V-shaped groove running through said cladding means.

6. The clad mailbox of claim 1, wherein said main housing includes a lid for opening and closing said mailbox.

7. The clad mailbox of claim 6, further including cladding means for said lid.

8. The clad mailbox of claim 1, wherein said cladding means is a series of wood panels.

* * * * *